US006994162B2

(12) United States Patent
Robison

(10) Patent No.: US 6,994,162 B2
(45) Date of Patent: Feb. 7, 2006

(54) LINEAR DISPLACEMENT MEASUREMENT METHOD AND APPARATUS

(75) Inventor: Clark E. Robison, Tomball, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 190 days.

(21) Appl. No.: 10/348,608

(22) Filed: Jan. 21, 2003

(65) Prior Publication Data

US 2004/0140092 A1 Jul. 22, 2004

(51) Int. Cl.
*E21B 44/06* (2006.01)

(52) U.S. Cl. ..... 166/250.01; 166/250.15; 166/53

(58) Field of Classification Search ..... 166/250.15, 166/50, 51, 65.1, 53, 313, 369, 250.01; 367/81, 367/82; 340/854.9, 855.1
See application file for complete search history.

(56) References Cited

U.S. PATENT DOCUMENTS

| | | | | |
|---|---|---|---|---|
| 4,560,005 | A | 12/1985 | Helderle et al. | |
| 4,848,457 | A | 7/1989 | Lilley | |
| 5,211,241 | A | 5/1993 | Mashaw, Jr. et al. | |
| 5,263,683 | A | 11/1993 | Wong | |
| 5,485,745 | A * | 1/1996 | Rademaker et al. | 73/152.39 |
| 5,892,860 | A | 4/1999 | Maron et al. | 385/12 |
| 5,933,945 | A * | 8/1999 | Thomeer et al. | 29/825 |
| 5,987,197 | A | 11/1999 | Kersey | 385/24 |
| 6,044,908 | A | 4/2000 | Wyatt | |
| 6,065,538 | A * | 5/2000 | Reimers et al. | 166/250.01 |
| 6,176,323 | B1 * | 1/2001 | Weirich et al. | 175/40 |
| 6,227,114 | B1 | 5/2001 | Wu et al. | 102/201 |
| 6,235,848 | B1 * | 5/2001 | Bickert et al. | 525/326.5 |
| 6,257,332 | B1 | 7/2001 | Vidrine et al. | |
| 6,268,911 | B1 * | 7/2001 | Tubel et al. | 356/72 |
| 6,354,147 | B1 | 3/2002 | Gysling et al. | 73/61.79 |
| 6,450,037 | B1 * | 9/2002 | McGuinn et al. | 73/705 |
| 6,462,329 | B1 | 10/2002 | Davis et al. | 250/227.14 |
| 6,484,800 | B2 | 11/2002 | Carmody et al. | 166/53 |
| 2003/0127232 | A1 | 7/2003 | Bussear et al. | |
| 2004/0135075 | A1 | 7/2004 | Hay et al. | |
| 2004/0163809 | A1 | 8/2004 | Mayeu et al. | |

OTHER PUBLICATIONS

U.K. Search Report, Application No. GB0401315.7, dated Jun. 29, 2004.

* cited by examiner

*Primary Examiner*—Frank S. Tsay
(74) *Attorney, Agent, or Firm*—Patterson & Sheridan, L.L.P.

(57) ABSTRACT

Methods and apparatus for detecting an operation of a downhole tool using an optical sensing system are disclosed. In an embodiment, a flow control device has an inner tubular member moveable relative to an outer tubular member and a thermally responsive chamber capable of a change in temperature during a movement between the inner tubular member and the outer tubular member. Detecting the change in temperature in the thermally responsive chamber with an optical sensing system provides real time knowledge of the position of the flow control device. In another embodiment, a flow control device comprises an inner tubular member moveable relative to an outer tubular member that produces an acoustic signal during a movement between the inner tubular member and the outer tubular member. Detecting the acoustic signal with an optical sensor provides real time knowledge of the position of the flow control device.

34 Claims, 9 Drawing Sheets

LINEAR DISPLACEMENT MEASUREMENT METHOD AND APPARATUS

BACKGROUND OF THE INVENTION

1. Field of the Invention

Embodiments of the present invention generally relate to apparatus and methods for detecting an operation of a downhole tool. More particularly, embodiments of the present invention generally relate to using optical sensing systems to detect an operation of the downhole tool. More particularly still, embodiments of the present invention generally relate to detecting a position of a flow control device.

2. Description of the Related Art

In the drilling of oil and gas wells, a wellbore is formed using a drill bit that is urged downwardly at a lower end of a drill string. After drilling the wellbore to a predetermined depth, the drill string and bit are removed. Thereafter, the wellbore is typically lined with a string of steel pipe called casing. The casing provides support to the wellbore and facilitates the isolation of certain areas of the wellbore adjacent hydrocarbon bearing formations. It is common to employ more than one string of casing in a wellbore. The casing can be perforated in order to allow the inflow of hydrocarbons into the wellbore. In some instances, a lower portion of the wellbore is left open by not lining the wellbore with casing. To control particle flow from unconsolidated formations, slotted tubulars or well screens are often employed downhole along the uncased portion of the wellbore. A production tubing run into the wellbore typically provides a flow path for hydrocarbons to travel through to a surface of the wellbore.

Controlling a flow of fluid into or out of tubulars at various locations in the wellbore often becomes necessary. For example, the flow from a particular location along the production tubing may need to be restricted due to production of water that can be detrimental to wellbore operations since it decreases the production of oil and must be separated and disposed of at the surface of the well which increases production costs. Flow control devices that restrict inflow or outflow from a tubular can be remotely operated from the surface of the well or another location. For example, the flow control device can comprise a sliding sleeve remotely operable by hydraulic pressure in order to align or misalign a flow port of the sliding sleeve with apertures in a body of the flow control device. This operation can be performed remotely without any intervention, and there is typically no feedback on the actual position or status of the flow control devices within the wellbore.

In wells equipped with electrical sensing systems that rely on the use of electrically operated devices with signals communicated through electrical cables, electrical sensors are available that can determine a position or status of flow control devices. Examples of such devices used to determine positions of flow control devices include linear variable differential transducers (LVDT). However, problems associated with electrical cables include degradation of the cable and significant cable resistance due to long electrical path lengths downhole that require both large power requirements and the use of large cables within a limited space available in production strings. Additionally, electrical sensors comprising inherently complex electronics prone to many different modes of failure must be extremely reliable since early failure may require a very time consuming and expensive well intervention for replacement. There are numerous other problems associated with the transmission of electrical signals within wellbores including difficulties encountered in providing an insulated electrical conductor due to the harsh environment and interferences from electrical noises in some production operations.

Therefore, many wells utilize optical sensing systems equipped with optical fibers and optical sensing techniques capable of measuring thermal changes, pressure changes, and acoustic signals. Unlike electrical sensors, optical sensors lack the ability to directly determine whether a mechanical operation downhole has been performed. For example, optical sensors can not directly determine a position of a sleeve on a flow control device.

Therefore, there exists a need for apparatus and methods that provide real time knowledge of the operation, position, and/or status of downhole tools in wellbores. There exists a further need for apparatus and methods for detecting a mechanical operation of downhole tools utilizing optical sensing systems.

SUMMARY OF THE INVENTION

The present invention generally relates to methods and apparatus for detecting an operation of a downhole tool. In an embodiment, a flow control device has an inner tubular member moveable relative to an outer tubular member and a thermally responsive chamber capable of a change in temperature during a movement between the inner tubular member and the outer tubular member. Detecting the change in temperature in the thermally responsive chamber with an optical sensing system provides real time knowledge of the position of the flow control device. In another embodiment, a flow control device has an inner tubular member moveable relative to an outer tubular member that produces an acoustic signal during a movement between the inner tubular member and the outer tubular member. Detecting the acoustic signal with an optical sensor provides real time knowledge of the position of the flow control device.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 1:
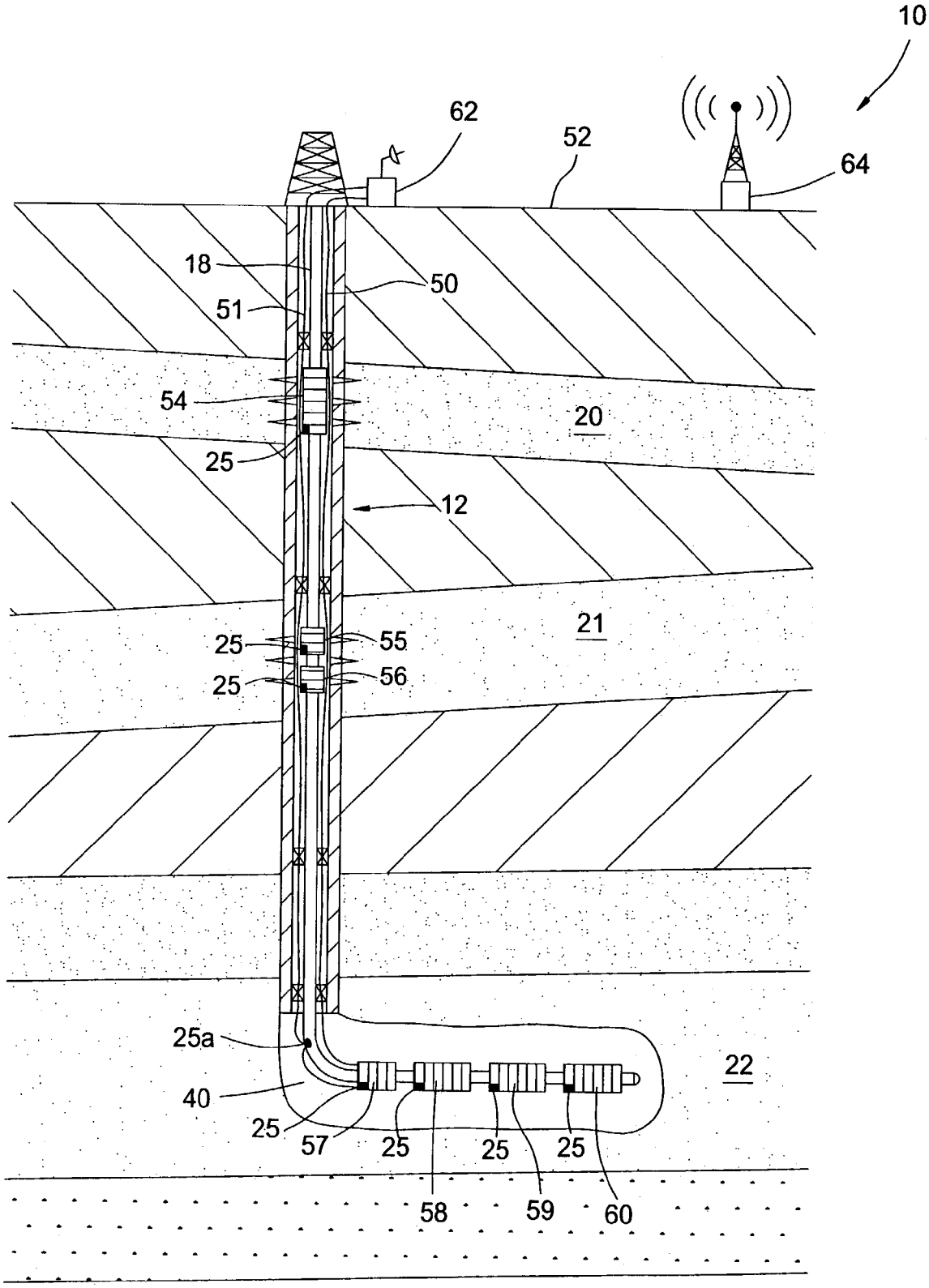
FIG. 1 is a cross-sectional view of a plurality of flow control devices coupled to a string of tubing run into a wellbore.

The present invention generally relates to methods and apparatus for detecting an operation of a downhole tool such as a flow control device by using an optical sensing system. FIG. 1 is a cross-sectional view of a hydrocarbon well 10 having a plurality of flow control devices 54–60 coupled to a string of tubing 18 run in a wellbore 12. Therefore, flow rate from formations 20–22 can be controlled by the flow control devices 54–56 adjacent perforations in a cased portion of the wellbore 12 and the flow control devices 57–60 positioned in an open portion 40 of the wellbore 12. At least one control line 50 and at least one signal line such as an optical fiber 51 containing a light guiding core that guides light along the optical fiber runs from a surface 52 to the flow control devices 54–60.

The control line 50 and the optical fiber 51 may be disposed independently or together on the outside surface of the tubing 18 by clamps (not shown) that are adapted to cover and protect the control line 50 and/or the optical fiber 51 on the tubing 18 during run-in and operation in the well 10. The optical fiber 51 is preferably attached by appropriate means, such as threads, a weld, or other suitable method, to the flow control devices 54–60. In the wellbore 12, the optical fiber 51 can be protected from mechanical damage by placing it inside a protective covering (not shown) such as a capillary tube made of a high strength, rigid walled, corrosion-resistant material, such as stainless steel.

A hydraulic pressure and/or an electric current supplied through the control line 50 is adapted to individually or collectively set each flow control device 54–60 in an open position, a closed position, or a position between the open position and the closed position in order to control a flow of fluid between the outside and the inside of the tubing 18. The control line 50 is coupled to a controller 62 at the surface 52 that adjusts the flow control devices 54–60 by operating the control line 50 through an automated or operator controlled process. The controller 62 may be self-controlled, may be controlled by an operator at the surface 52, or may be controlled by an operator that sends commands to the controller 62 through wireless or hard-line communications from a remote location 64, such as at an adjacent oil rig.

Figure 2:
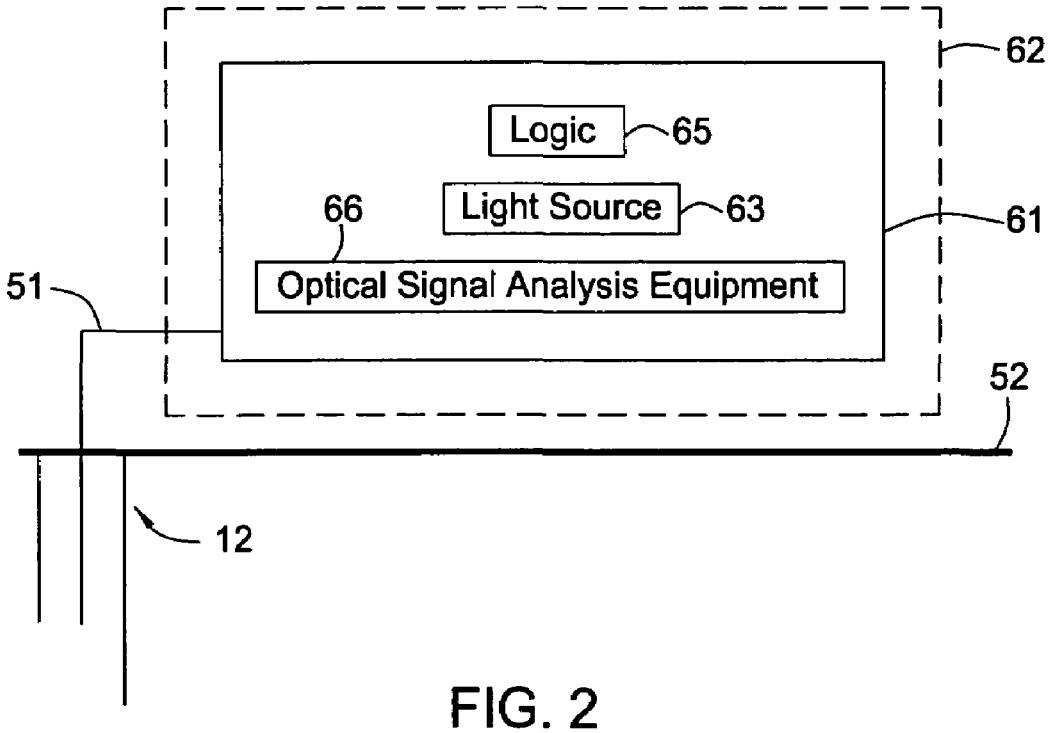
FIG. 2 is a schematic view of instrumentation for an optical sensing system.

As schematically shown in FIG. 2 the optical fiber 51 extends from the controller 62 at the surface 52 into the wellbore 12. FIG. 2 illustrates the minimum instrumentation 61 necessary to interface with the optical fiber 51. At the controller 62, the optical fiber 51 couples to the instrumentation 61 that includes a signal interface and logic for interpreting the signal and outputting information to an operator. The instrumentation 61 used with the optical fiber 51 includes a broadband light source 63, such as a light emitting diode (LED), appropriate equipment for delivery of a signal light to the optical fiber 51, optical signal analysis equipment 66 for analyzing a return signal (reflected light) and converting the return signal into a signal compatible with a logic circuitry 65, and logic circuitry 65 for interpreting the signal and outputting information to an operator. The information may further be used by the controller 62 to operate the flow control devices 54–60 (shown in FIG. 1). Depending on a specific arrangement, multiple optical sensors 25, 25A (shown in FIG. 1) may be on a common optical fiber 51 or distributed among multiple fibers. The optical fiber 51 may be connected to other sensors (e.g., further downhole), terminated, or connected back to the instrumentation 61. Additionally, any suitable combination of peripheral elements (not shown) such as fiber optic cable connectors, splitters, etc. that are well known in the art for coupling one or more optical fibers 51 can be utilized.

Figure 3:
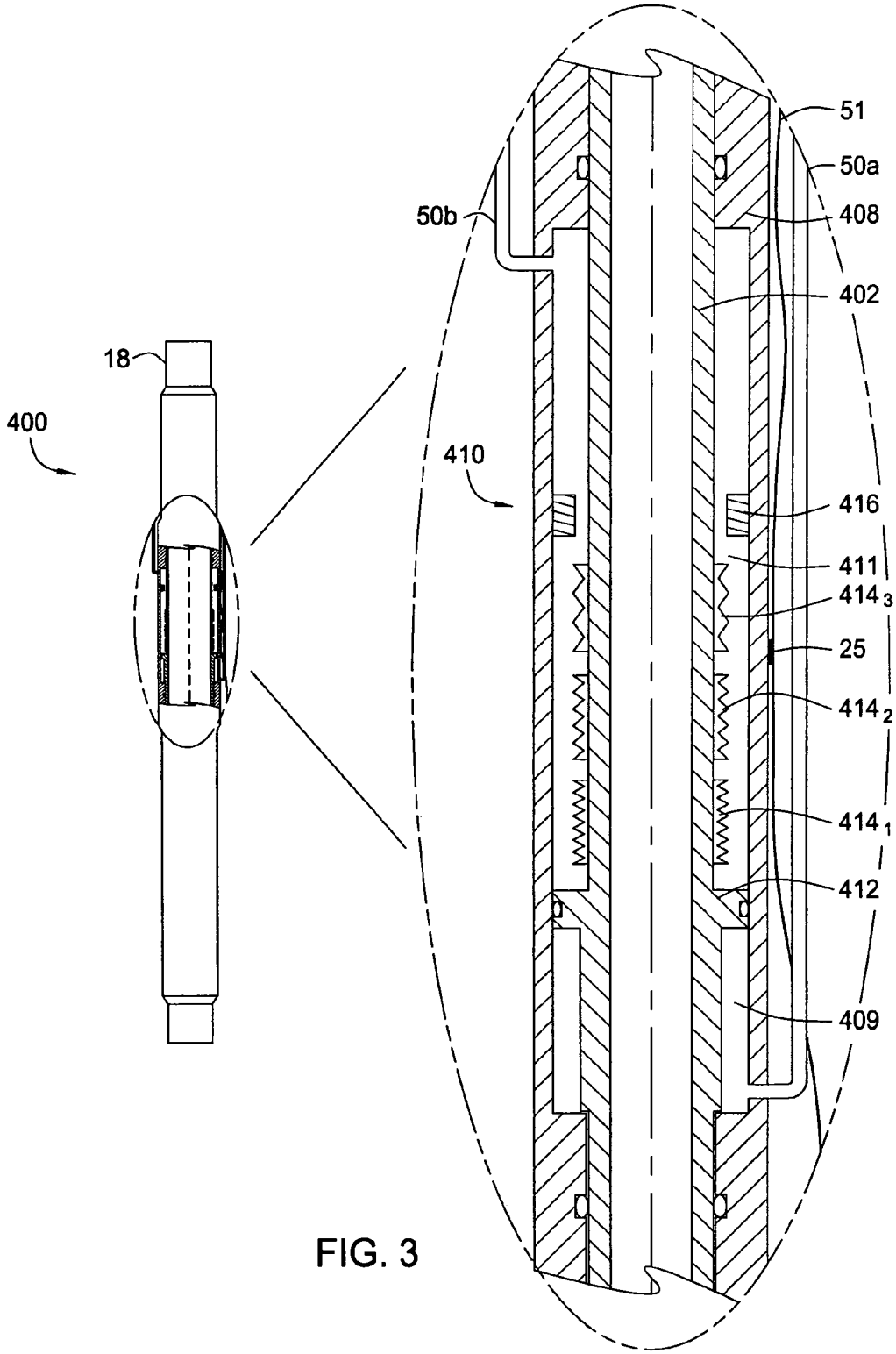
FIG. 3 is a sectional view of a flow control device in a closed position that utilizes an acoustic optical sensor.
Figure 4:
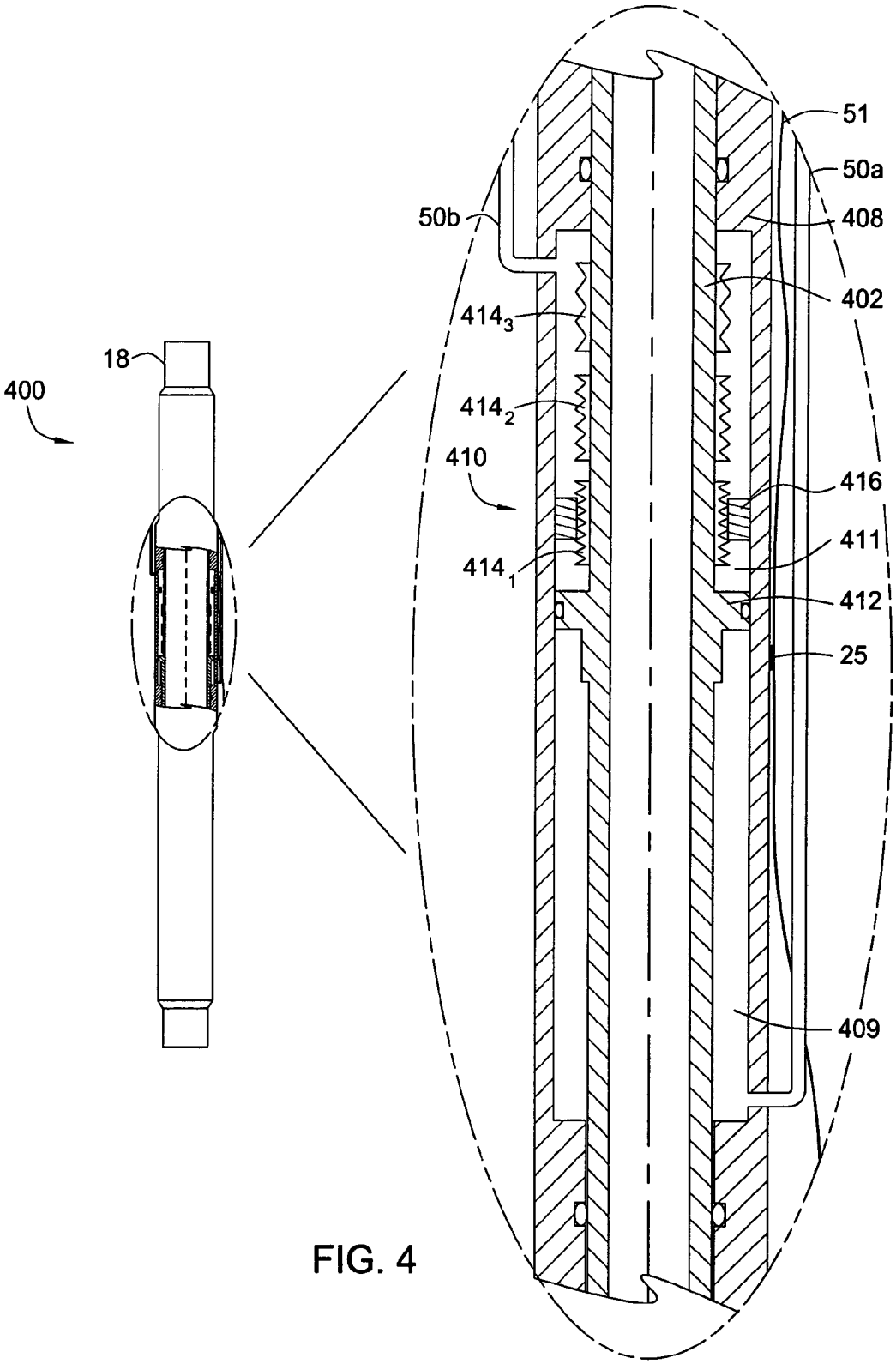
FIG. 4 is a sectional view of the flow control device shown in FIG. 3 in an open position.
Figure 5:
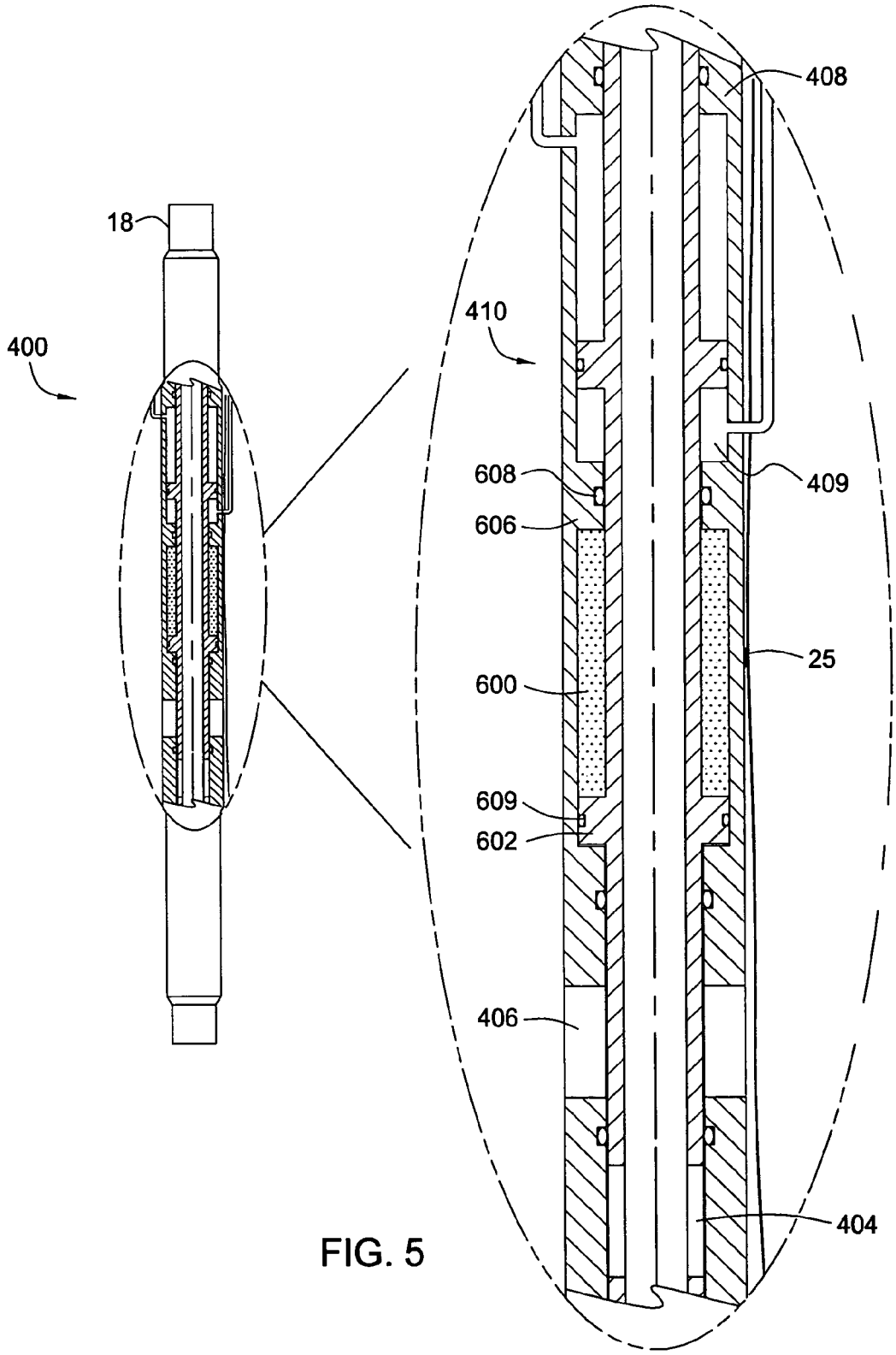
FIG. 5 is a sectional view of another embodiment of a flow control device in a closed position that utilizes an optical sensing system capable of detecting thermal changes.
Figure 6:
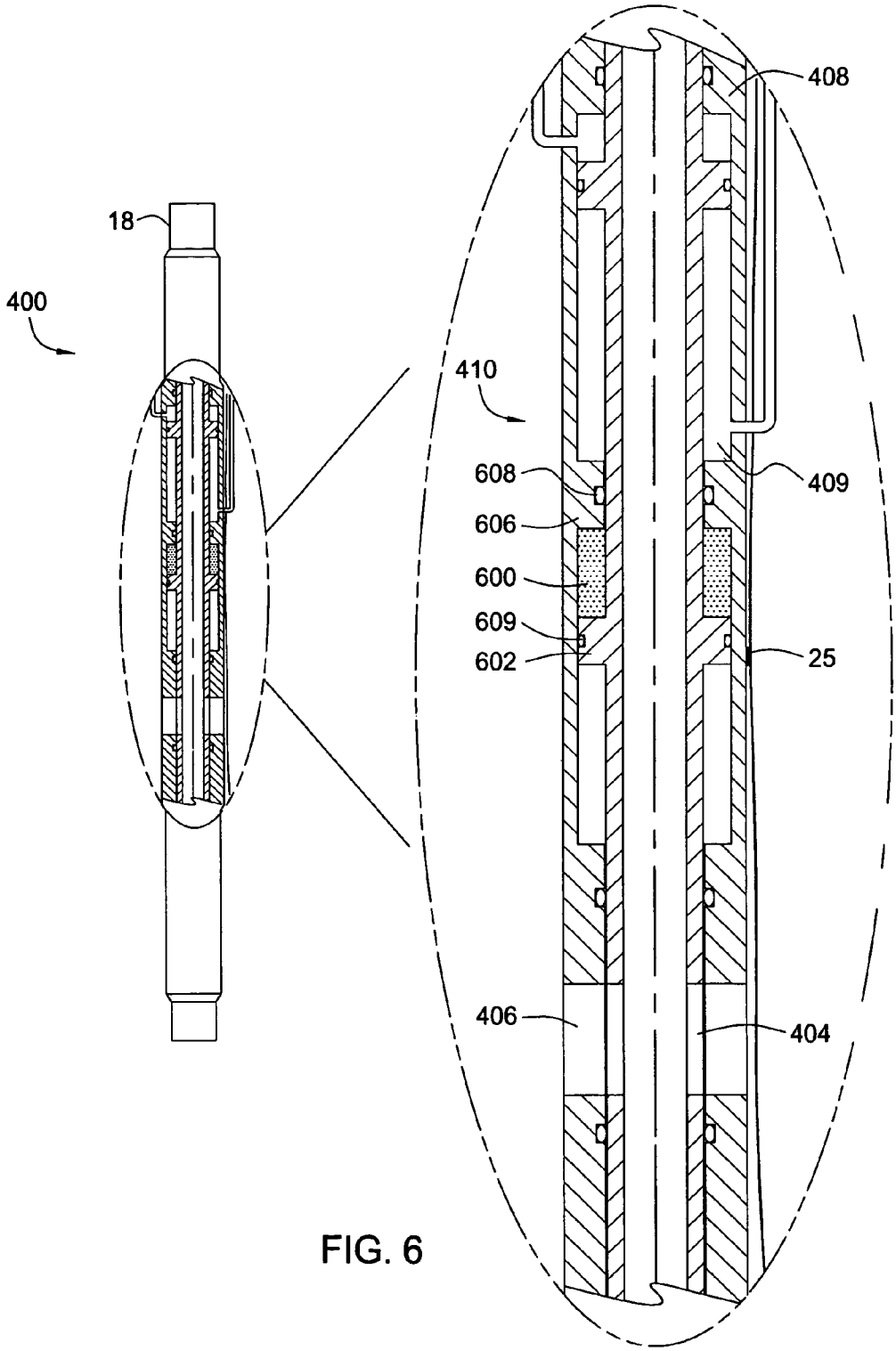
FIG. 6 is a sectional view of the flow control device shown in FIG. 5 in an open position.
Figure 7:
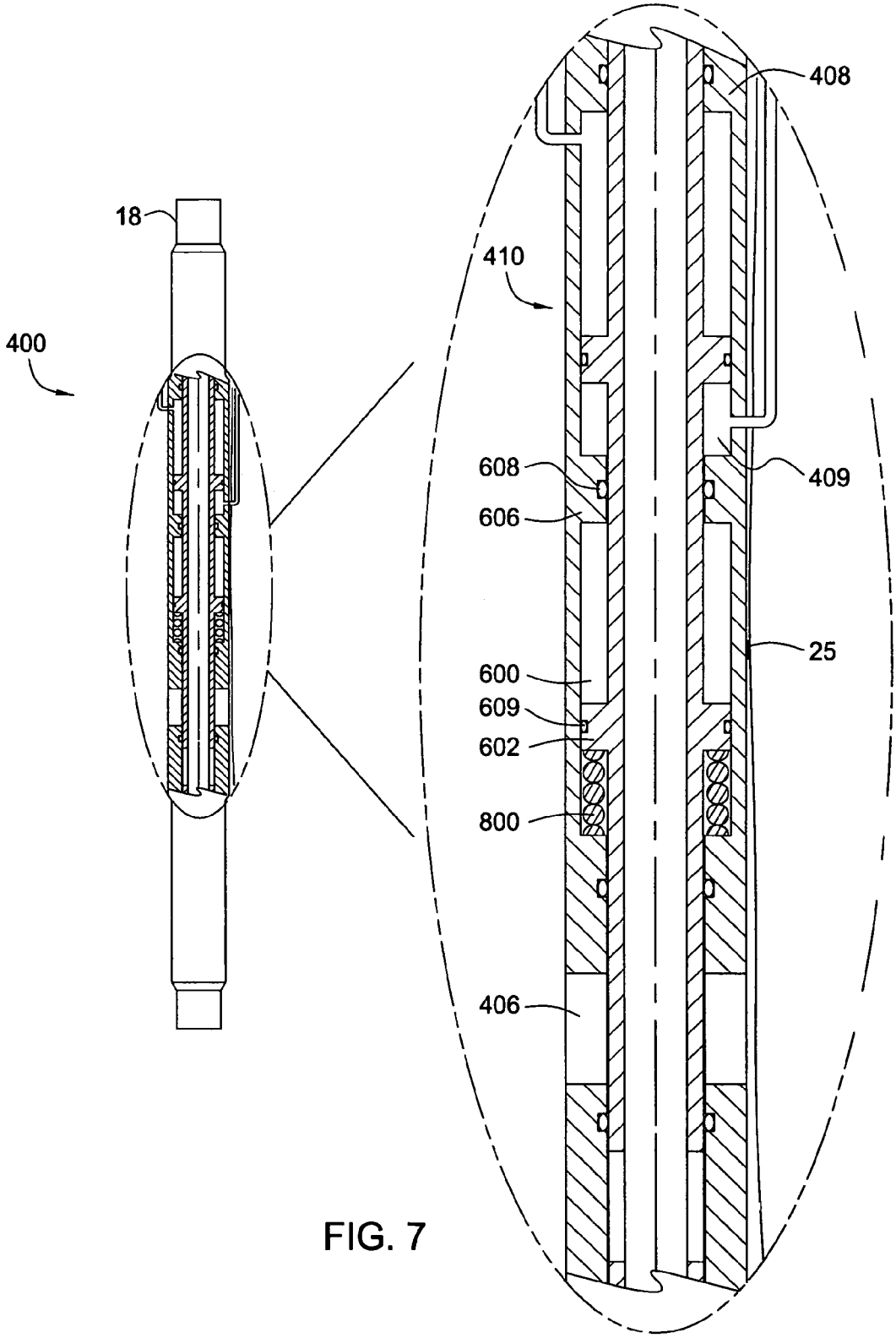
FIG. 7 is a sectional view of another embodiment of a flow control device in a closed position that utilizes an optical sensing system capable of detecting thermal changes.
Figure 8:
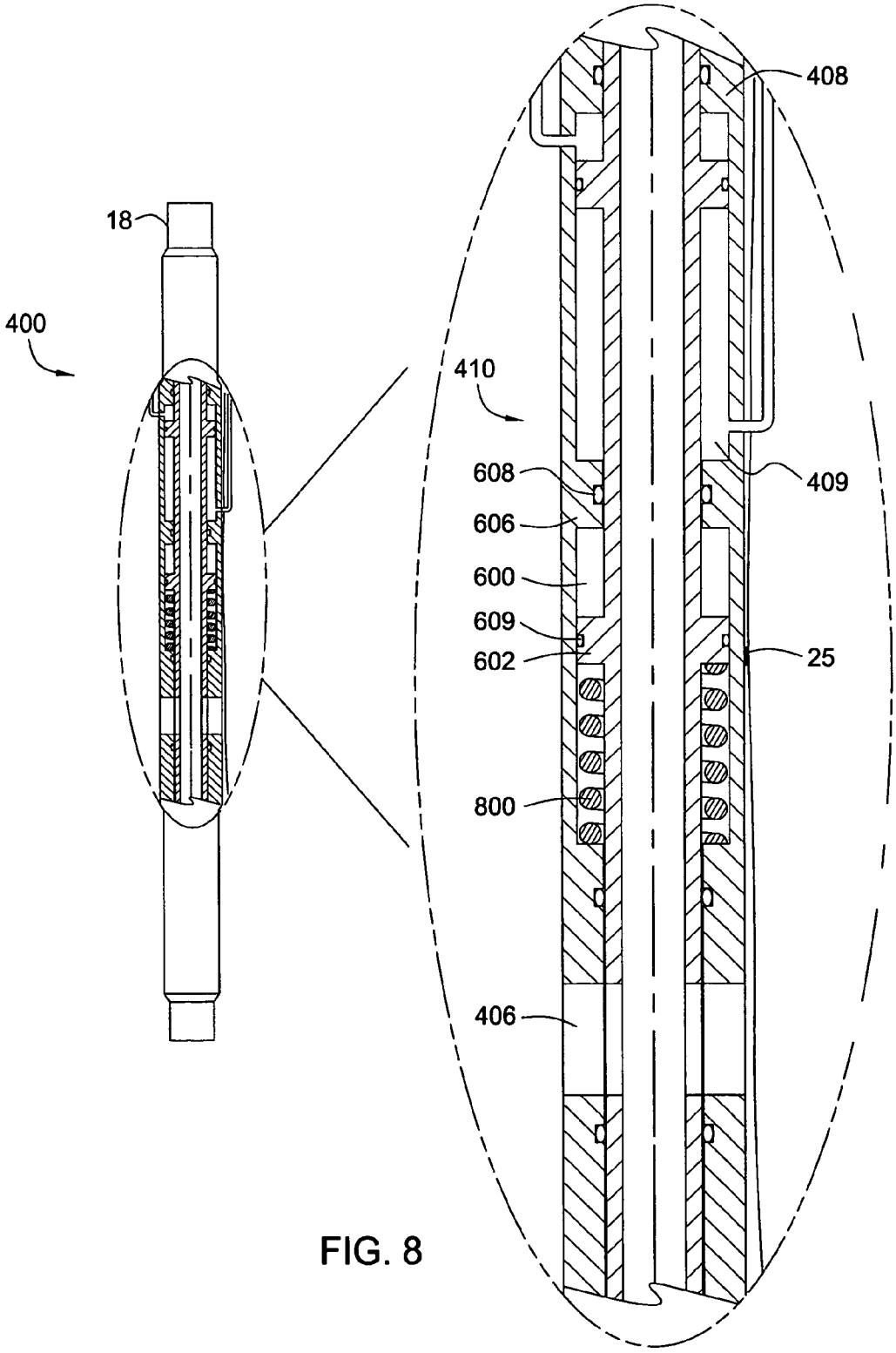
FIG. 8 is a sectional view of the flow control device shown in FIG. 7 in an open position.

FIGS. 3–8 illustrate exemplary hydraulically operated flow control devices with a common reference number 400 that provide examples of the flow control devices 54–60 shown in FIG. 1. As illustrated in FIG. 3, the flow control device 400 comprises an inner tubular member 402 having inner tubular member apertures 404 (shown in FIG. 5) formed in a wall thereof. The inner tubular member apertures 404 provide fluid communication between an outside and an inside of the flow control device 400 only when aligned with outer tubular member apertures 406 (shown in FIG. 5) formed in a wall of an outer tubular member 408. An operating piston assembly 410 within an annular area between the inner tubular member 402 and the outer tubular member 408 provides the ability to convey relative movement between the tubular members 402, 408. A portion 412 of the inner tubular member 402 isolates a first chamber 409 from a second chamber 411 in order to provide the operating piston assembly 410. Therefore, applying fluid pressure to a first line 50A of the control line 50 that is in communication with the first chamber 409 while relieving fluid pressure from the second chamber 411 via a second line 50B of the control line 50 moves the inner tubular member 402 relative to the outer tubular member 408. As shown in FIG. 3, the flow control device 400 is in a closed position wherein fluid flow is restricted between the outside and the inside of the flow control device 400 in comparison to an open position wherein the inner tubular member 402 is raised relative to the outer tubular member 408 in order to align apertures 404, 406 as shown in FIG. 6. Of course, the flow control device 400 may be adapted so that it may be set in any position between the open position and the closed position. In this manner, the flow of fluid into the wellbore at the location of the apertures 404, 406 is controlled.

Referring back to FIG. 3, an optical sensing system can be used with an embodiment of the flow control device 400 to determine whether the flow control device 400 has been operated. The optical sensing system can comprise an optical sensor 25 connected to an optical fiber 51. The optical sensor 25 may be capable of detecting an acoustic signal, for example, generated by an acoustic signal generating assembly (e.g., a "noise maker") formed within the flow control device 400. As an example, the acoustic signal generating assembly may comprise raised formations 414 formed on the outside diameter of the inner tubular member 402 and a ring 416 on the inner surface of the outer tubular member 408. As shown, the raised formations 414 (three sets of raised formations $\mathbf{414}_1$, $\mathbf{414}_2$, and $\mathbf{414}_3$ are shown) and the ring 416 are positioned within the operating piston assembly 410; however, they can be placed at any point along the length of the flow control device 400 where there is relative movement between the inner tubular member 402 and the outer tubular member 408. Contact such as frictional contact between the formations 414 and the ring 416 provides the acoustic signal. One skilled in the art could envision other designs for the acoustic signal generating assembly that can provide the acoustic signal.

Regardless of the exact design of the acoustic signal generating assembly, the optical sensor 25 can utilize pressure stress applied on a strain sensor in order to detect the acoustic signal. For example, the optical sensors 25 can utilize strain-sensitive Bragg gratings formed in a core of the optical fiber 51. Therefore, the optical sensor 25 can possess a tight match with the outer tubular member 408 in order to transfer sound energy from the flow control device 400 to the optical sensor 25. As described in detail in commonly-owned U.S. Pat. No. 5,892,860, entitled "Multi-Parameter Fiber Optic Sensor For Use In Harsh Environments," issued Apr. 6, 1999 and incorporated herein by reference in its entirety, such sensors 25 are suitable for detecting acoustic vibrations in very hostile and remote environments, such as found downhole in wellbores. Commonly-owned U.S. Pat. No. 6,354,147, entitled "Fluid Parameter Measurement in Pipes Using Acoustic Pressures," issued Mar. 12, 2002 and incorporated herein by reference in its entirety further illustrates optical acoustic sensors in use.

FIG. 4 illustrates the flow control device 400 in the open position. During the movement from the closed position as shown in FIG. 3 to the open position, the raised formations 414 on the inner tubular member 402 contact and pass along the ring 416 on the outer tubular member 408 thereby emanating the acoustic signal. Therefore, an axial position of the inner tubular member 402 relative to the outer tubular member 408 can be determined by the presence of the acoustic signal and/or the frequency of the acoustic signal. FIG. 4 illustrates variations in the raised formations 414 that can provide acoustic signals having different frequencies. These variations of the raised formations 414 in the acoustic signal generating assembly correspond to positions of the flow control device between the open position and the closed position. For example, the raised formations $\mathbf{414}_3$ can provide a first frequency upon initial movement from the closed position as the inner tubular member 402 moves relative to the outer tubular 408, the raised formations $\mathbf{414}_2$ can provide a second frequency during movement to an intermediate position between the open position and the closed position, and the raised formations $\mathbf{414}_1$ can provide a third frequency immediately preceding the flow control device 400 fully reaching the open position. These alterations to the acoustic signal can be provided by changing spacing of the formations 414, changing size and shape of the formations 414 (as shown) or changing a composition of the formations 414. Therefore, detecting the acoustic signal and distinguishing the first frequency, the second frequency, and the third frequency produced by variations of the raised formations 414 in the acoustic signal generating assembly detects whether the flow control device has been operated to the open position, the intermediate position, or the closed position.

Depending upon the background noise present, the optical sensor 25 can detect an acoustic signal emanated by the movement of the inner tubular member 402 within the outer tubular member 408 even without the acoustic signal generating assembly. Further, the optical sensor 25 may be capable of passively detecting a change in acoustical noise generated by the flow of fluid through the flow control device 400 in the closed position when compared to the flow of fluid through the flow control device 400 in the open position since fluid entering through apertures 404, 406 creates acoustic noise, which may be changed by additional fluid flow through the inner tubular member 402. Similarly, for some embodiments, the optical sensor 25 may be used to detect deposits on the inside of the tubular 18 (shown in FIG. 1) or in sandscreens, because such deposits may also change the acoustical noise generated by the flow of fluid through the flow control device 400.

Referring back to FIG. 1, the flow control devices 54–60 may each have an acoustic signal generating assembly capable of producing an acoustic signal with a unique frequency, or set of frequencies as described above. Therefore, for some embodiments, an optical sensor 25A may be positioned on the tubing 18 within the wellbore 12 in order to detect the acoustic signal from any of the flow control devices 54–60. In one embodiment the optical sensor 25A may be replaced with a microphone (not shown) if a signal line having a conductive material is used in the wellbore 12. Since each of the flow control devices 54–60 emanates acoustic signals with frequencies unique to that particular flow control device, an operator can determine which of the flow control devices 54–60 has been operated. As shown, the optical sensor 25A is centrally located between the flow control devices 54–60; however, it can also be positioned between the surface 52 and the first flow control device 54 in order to provide a time domain based on when a change in flow is detected using the optical sensor 25A relative to when the optical sensor 25A detects the acoustic signal from one of the flow control devices 54–60. Utilizing one optical sensor 25A to detect the acoustic signal produced by all of the flow control devices 54–60 reduces the total number of sensors required to detect the operation of the flow control devices 54–60. Alternatively, multiple optical sensors 25 may be positioned adjacent each of the flow control devices 54–60, or there may be one optical sensor such as the optical sensor 25A for detecting operations of flow control devices 54–56 and a second optical sensor for detecting operations of flow control devices 57–60.

FIG. 5 illustrates another embodiment of a flow control device 400 having an optical sensing system and a thermally responsive chamber 600 defined by an annular area between the inner tubular member 402 and the outer tubular member 408. An outwardly biased shoulder 602 of the inner tubular member 402 and an inwardly biased shoulder 606 of the outer tubular member 408 further define the thermally responsive chamber 600. The thermally responsive chamber 600 comprises a fluid or gas that changes temperature when it changes volume. Examples of fluids that change temperature based on a change in volume include nitrogen gas and some refrigerants. As shown in FIG. 5, the thermally responsive chamber 600 is sealed by seals 608, 609 and is at a maximum volume when the flow control device 400 is in the closed position.

FIG. 6 illustrates the flow control device 400 after being operated in order to place it in the open position. During movement of the flow control device from the closed position to the open position, the shoulder 602 of the inner tubular member 402 moves closer to the shoulder 606 of the outer tubular member. Therefore, placing the flow control device 400 from the closed position as shown in FIG. 5 to the open position places the thermally responsive chamber 600 at a minimum volume. Since the thermally responsive chamber 600 is sealed, the fluid or gas compresses in the thermally responsive chamber 600 causing the fluid or gas therein to change temperature and thereby heat the area of the flow control device 400 adjacent to the thermally responsive chamber 600. Alternatively, the fluid or gas can be placed within a thermally responsive chamber that increases in volume when the flow control device 400 moves from the closed position to the open position thereby decompressing the fluid or gas therein and cooling the area adjacent the thermally responsive chamber 600.

Regardless, the optical sensing system can use an optical fiber 51 with an optical sensor 25 adjacent or attached to the flow control device 400 to detect the change in temperature near the thermally responsive chamber 600. The optical sensor 25 can utilize pressure stress applied on a strain sensor in order to detect the change in temperature. As described in previously referenced U.S. Pat. No. 5,892,860, the optical sensors 25 can utilize strain-sensitive Bragg gratings formed in a core of the optical fiber 51 in order to detect thermal changes.

Alternatively, the optical fiber 51 can be used without the optical sensor 25 to detect the change in temperature by using distributed temperature measurement. Temperature changes of the fiber itself alters properties of the optical fiber 51 thereby changing a backscattering of a small proportion of the incident light. Given the known velocity that light travels provides the ability to detect temperature changes at specific locations within the wellbore. Therefore, the thermally responsive chamber 600 transfers the change in temperature to the adjacent optical fiber 51 positioned within a groove on the outside of the flow control device 400 and this change in temperature is detected by distributed temperature measurement. Detecting the change in temperature with the optical sensor 25 or by using the distributed temperature measurement confirms that the flow control device 400 has moved between the closed position and the open position.

The optical sensor 25 may be used to detect a pressure change within the chamber 600. Detecting pressure changes with optical sensors is further described in commonly owned U.S. Pat. No. 6,450,037, entitled "Non-Intrusive Fiber Optic Pressure Sensor for Measuring Unsteady Pressures within a Pipe," and that patent is hereby incorporated by reference in its entirety. In this manner, the chamber 600 does not have to be filled with a thermally responsive fluid or gas that provides a temperature change since the sensor 25 merely detects a pressure change.

Similar to FIG. 5 and FIG. 6, FIG. 7 and FIG. 8 illustrate an embodiment of a flow control device 400 utilizing a thermally responsive chamber 600 to detect an operation of the flow control device 400 with an optical sensing system such as an optical sensor 25 within an optical fiber 51 or a distributed temperature measurement based on a thermal change in the optical fiber 51. However, a stress resistant material 800 shown shaped as a spring positioned within the thermally responsive chamber 600 replaces the thermally responsive fluid or gas, and the stress resistant material 800 dissipates heat when stressed. Moving the flow control device 400 from the closed position with the thermally responsive chamber 600 in its maximum volume shown in FIG. 7 to the open position with the thermally responsive chamber 600 in its minimum volume shown in FIG. 8 compresses the stress resistant material 800 thereby heating the thermally responsive chamber 600 and an adjacent area of the flow control device 400. An example of the stress resistant material 800 that dissipates heat when stressed is inconel. Thus, detecting the change in temperature caused by the stress resistant material 800 with the optical sensor 25 or by using the distributed temperature measurement confirms operation of the flow control device 400.

Embodiments of the present invention have been described and illustrated in use with flow control devices that utilize a hydraulically operated inner tubular member or sleeve. However, one skilled in the art could envision utilizing embodiments described herein with any flow control device or other tool, such as a packer setting, that provides a mechanical movement when operated. For example, a linear movement of a member within the packer may be required to set wedges of the packer setting similar to the linear movement provided between the inner tubular member 402 and the outer tubular member 408 of the flow control device 400 shown in FIG. 4 through FIG. 8. Since there is provided a similar linear movement, a similar acoustic signal generating assembly or thermally responsive chamber can be incorporated with the packer setting. Therefore, either use of a distributed temperature measurement of an optical fiber to detect the temperature change or use of an optical sensor to detect either the temperature change, the pressure change, or the generated acoustic signal confirms operation of the tool.

Figure 9:
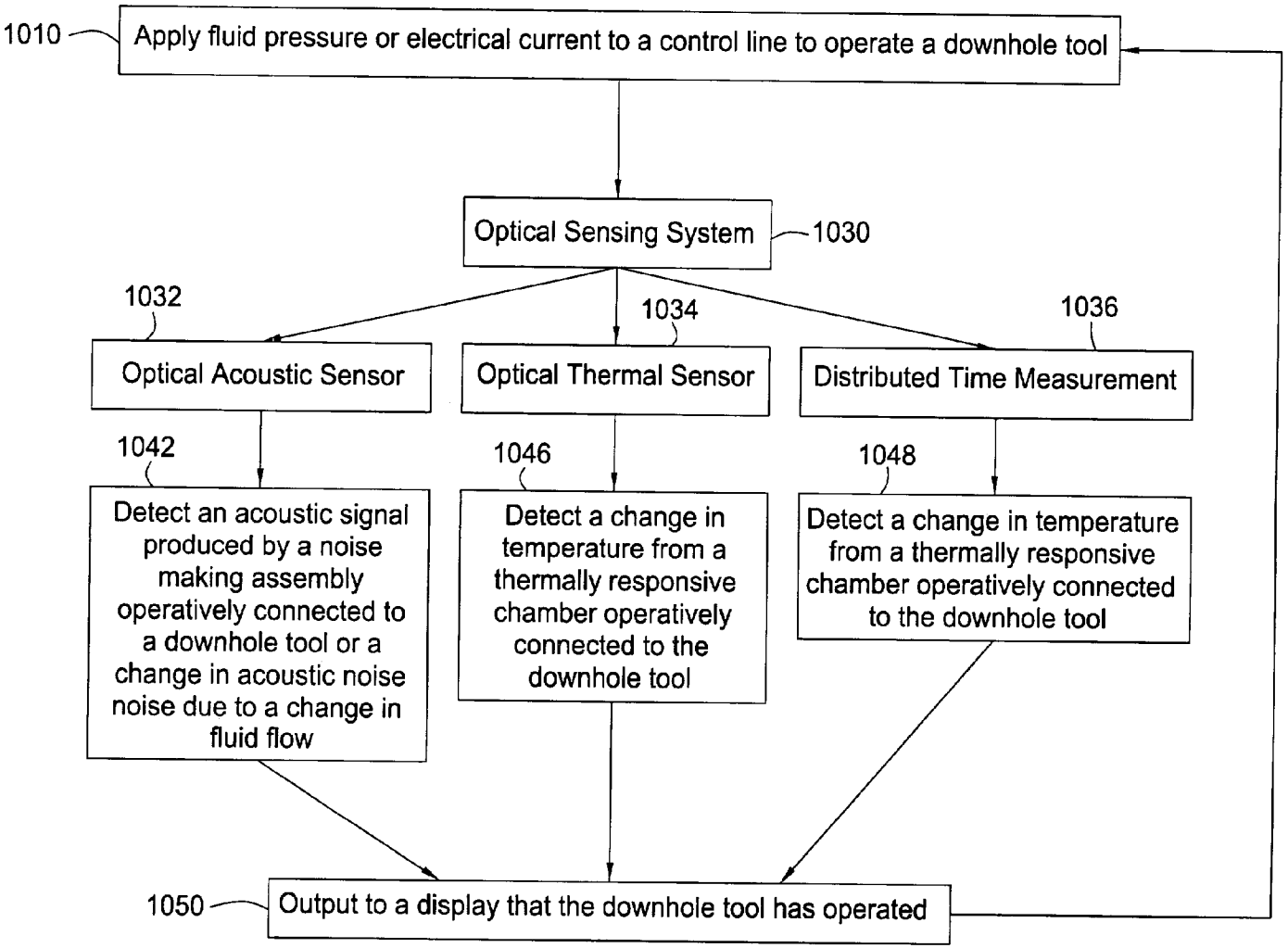
FIG. 9 is a diagram illustrating embodiments of the invention in operation in order to provide a method for detecting an operation of a downhole tool.

FIG. 9 diagrams embodiments of the invention in operation in order to provide a method for detecting an operation of a downhole tool such as a flow control device. As shown at step 1010, a fluid pressure or electrical current is applied to the downhole tool via a control line in order to operate the downhole tool. In order to determine whether the fluid pressure or electrical current actually operates the downhole tool, the well is equipped with an optical sensing system 1030. The optical sensing system 1030 can comprise optical acoustic sensors 1032, optical thermal sensors 1034, and/or a distributed time measurement method 1036 that is capable of detecting thermal changes. According to embodiments of the invention, an acoustic signal generating assembly operatively connected to the downhole tool can produce an acoustic signal. Alternatively, a thermally responsive chamber operatively connected to the downhole tool can produce a change in temperature near the thermally responsive chamber. In this manner, operation of the downhole tool produces the acoustic signal or the change in temperature near the thermally responsive chamber. Thus, detecting the acoustic signal, at step 1042, detecting the change in temperature with the thermal senor, at step 1046, or detecting the change in temperature by using a distributed time measurement, at step 1048, determines that the downhole tool has operated. At step 1050, a display indicates that the downhole tool has operated upon detection of the acoustic signal or the change in temperature using the optical sensing system. The display may be part of the controller 62 shown in FIG. 1 at the surface 52 of the well 10 that allows for an operator to confirm operation of the downhole tool. As shown, the entire process can be iteratively performed, for example, so that fluid pressure or electrical current supplied to operate the downhole tool may be adjusted until the output is received indicating that the downhole tool has operated. Thus, the downhole tool may be automatically operated, for example until the tool has reached a desired operating position.

While the foregoing is directed to embodiments of the present invention, other and further embodiments of the invention may be devised without departing from the basic scope thereof, and the scope thereof is determined by the claims that follow.

What is claimed is:

1. A method for detecting an operation of a downhole tool, comprising:

operating the downhole tool, whereby the operating the downhole tool displaces a first member of an acoustic signal generating assembly relative to a second member of the acoustic signal generating assembly to generate an acoustic signal;

detecting the acoustic signal with an optical fiber based sensor; and verifying the operation based on detection of the acoustic signal.

2. A method for detecting an operation of a flow control device, comprising:

operating the flow control device, whereby the operating the flow control device provides an acoustic signal;

detecting the acoustic signal with an optical fiber based sensor; and verifying the operation based on detection of the acoustic signal, wherein verifying the operation comprises determining whether the flow control device is in an open position, a closed position, or a position between the open position and the closed position.

3. The method of claim 2, wherein operating the downhole tool provides the acoustic signal having a first frequency when the flow control device approaches the open position and a second frequency when the flow control device approaches the closed position.

4. The method of claim 2, wherein determining whether the flow control device is in the open position or the closed position comprises detecting flow through the flow control device based on the acoustic signal.

5. The method of claim 1, wherein the acoustic signal provides a frequency unique from other acoustic signals provided by operating other downhole tools.

6. The method of claim 5, further comprising determining which downhole tool provided the acoustic signal based on the frequency of the acoustic signal.

7. A method for detecting an operation of a downhole tool, comprising:

operating the downhole tool, whereby the operating the downhole tool provides an acoustic signal with a frequency unique from other acoustic signals provided by operating other downhole tools;

detecting the acoustic signals with an optical fiber based sensor;

determining which downhole tool provided the acoustic signals based on the frequency of the acoustic signals; and verifying the operation of the downhole tool based on detection of the acoustic signal, verifying an operation of the other downhole tools based on detecting the other acoustic signals.

8. A method for detecting an operation of a downhole tool, comprising:

operating the downhole tool, whereby the operating provides a change in a volume of a chamber;

detecting the change in the volume of the chamber with an optical fiber based sensor; and verifying operation of the tool based on detecting the change in the volume.

9. The method of claim 8, wherein the verifying the operation comprises determining whether a flow control device is in an open position, a closed position, or a position between the open position and the closed position.

10. The method of claim 8, wherein the detecting the change in the volume of the chamber comprises detecting a change in pressure within the chamber with the optical fiber based sensor.

11. The method of claim 8, wherein the detecting the change in the volume of the chamber comprises detecting a change in temperature within the chamber with the optical fiber based sensor.

12. The method of claim 11, wherein the detecting the change in the temperature of the chamber comprises a distributed temperature measurement of an optical fiber.

13. The method of claim 11, wherein the detecting the change in the temperature of the chamber comprises detecting the change in temperature with a Bragg grating based sensor.

14. The method of claim 11, further comprising compressing and decompressing a thermally responsive fluid within the chamber to provide a change in temperature.

15. The method of claim 8, further comprising stressing a stress resistant material within the chamber to provide a change in temperature.

16. A downhole tool for use in a wellbore, comprising:

an acoustic signal generating assembly adapted to produce an acoustic signal when the tool is operated, wherein the acoustic signal generating assembly comprises a first member and a second member that generate the acoustic signal In response to movement therebetween when the downhole tool is operated; and at least one optical fiber based sensor capable of detecting the acoustic signal.

17. The downhole tool of claim 16, wherein the at least one optical fiber based sensor comprises:

an optical fiber; and a Bragg grating within the optical fiber.

18. The downhole tool of claim 16, wherein the first member includes at least one protrusion.

19. The downhole tool of claim 18, wherein the first member comprises at least two sets of protrusions and each set of protrusions provides unique alterations in the acoustic signal.

20. A flow control device for use in a wellbore, comprising:

means for generating an acoustic signal when the flow control device is operated, wherein an inner tubular member of the flow control device moves relative to an outer tubular member of the flow control device; and at least one optical fiber based sensor capable of detecting the acoustic signal.

21. A downhole tool for use in a wellbore comprising:

a chamber that changes volume during an operation of the downhole tool; and an optical fiber based sensor capable of detecting change in the volume of the chamber.

22. The downhole tool of claim 21, wherein the optical sensing system comprises:

an optical fiber; and a Bragg grating formed in the optical fiber.

23. The downhole tool of claim 21, further comprising a fluid within the chamber that changes temperature in response to change in the volume of the chamber.

24. The downhole tool of claim 21, further comprising a material within the chamber that releases heat when stressed, wherein the material is stressed in response to change in the volume of the chamber.

25. The downhole tool of claim 21, wherein the downhole tool is a flow control device.

26. The downhole tool of claim 25, wherein the chamber comprises an annular area defined by an outside diameter of an inner tubular member of the flow control device and an inside diameter of an outer tubular member of the flow control device.

27. A system comprising:

at least one downhole tool for use in a wellbore having an acoustic signal generating assembly adapted to generate an acoustic signal in response to operation of the at least one downhole tool;

at least one additional downhole tool having an additional acoustic signal generating assembly adapted to generate an additional acoustic signal in response to operation of the at least one additional downhole tool;

at least one optical fiber based sensor to generate one or more optical signals in response to detecting the acoustic signals generated by the acoustic signal generating assemblies; and an interface at a surface of the wellbore adapted to provide an indication of operation of the downhole tools in response to the one or more optical signals.

28. A system comprising:

at least one flow control device for use in a wellbore having an acoustic signal generating assembly adapted to generate an acoustic signal in response to operation of the at least one downhole tool, wherein the acoustic signal generating assembly is adapted to provide the acoustic signal having a first frequency when the flow control device approaches a first position and a second frequency when the flow control device approaches a second position;

at least one optical fiber based sensor to generate one or more optical signals in response to detecting the acoustic signal generated by the acoustic signal generating assembly; and an interface at a surface of the wellbore adapted to provide an indication of operation of the at least one flow control device in response to the one or more optical signals.

29. The system of claim 28, wherein the acoustic signal generating assembly of each downhole tool generates a unique acoustic signal.

30. The system of claim 29, wherein the at least one optical fiber based sensor comprises a single optical fiber sensor capable of detecting the unique acoustic signal generated by each downhole tool.

31. A system comprising:

at least one downhole tool for use in a wellbore having a chamber that changes volume in response to operation of the at least one downhole tool;

at least one optical fiber based sensor to generate one or more optical signals in response to detecting change in the volume of the chamber; and an interface at a surface of the wellbore adapted to provide an indication of operation of the at least one downhole tool in response to the one or more optical signals.

32. The system of claim 31, further comprising at least one additional downhole tool, wherein the interface is further adapted to provide an indication of operation of each downhole tool.

33. The system of claim 32, wherein each downhole tool is coupled with a common optical fiber.

34. The system of claim 31, wherein the at least one optical fiber based sensor is an optical fiber used for distributed temperature sensing.

* * * * *